US010465386B2

(12) United States Patent
Iler et al.

(10) Patent No.: US 10,465,386 B2
(45) Date of Patent: Nov. 5, 2019

(54) CONCRETE SPACER WITH SUPPORTING ELEMENT

(71) Applicants: Marvin W Iler, Milaca, MN (US); James E Erdahl, Elk River, MN (US)

(72) Inventors: Marvin W Iler, Milaca, MN (US); James E Erdahl, Elk River, MN (US)

( * ) Notice: Subject to any disclaimer, the term of this patent is extended or adjusted under 35 U.S.C. 154(b) by 491 days.

(21) Appl. No.: 14/600,462

(22) Filed: Jan. 20, 2015

(65) Prior Publication Data

US 2015/0204076 A1 Jul. 23, 2015

Related U.S. Application Data

(60) Provisional application No. 61/929,820, filed on Jan. 21, 2014.

(51) Int. Cl.
*E04C 5/20* (2006.01)
*E04C 5/16* (2006.01)

(52) U.S. Cl.
CPC ..... *E04C 5/205* (2013.01); *E04C 5/168* (2013.01)

(58) Field of Classification Search
CPC . E04C 5/16; E04C 5/062; E04C 5/067; E04C 5/068; E04C 5/08; E04C 5/20; E04C 5/201; E04C 5/203; E04C 5/205; E04C 5/206; E04C 5/064; E04C 5/06; E04C 5/53; E04C 5/07; E04C 5/127; E04C 5/00; E04C 5/01; E04C 5/02; E04C 5/03; E04C 5/04; E04C 5/0627; E04C 5/0636; E04G 21/12; E04G 21/125
See application file for complete search history.

(56) References Cited

U.S. PATENT DOCUMENTS

| | | | | | |
|---|---|---|---|---|---|
| 1,268,887 | A * | 6/1918 | Schroeder | 52/687 |
| 4,318,262 | A * | 3/1982 | Uehara | 52/687 |
| 4,942,714 | A * | 7/1990 | Langley et al. | 52/687 |
| 5,555,693 | A * | 9/1996 | Sorkin | 52/689 |
| 5,791,095 | A * | 8/1998 | Sorkin | 52/105 |
| D483,246 | S * | 12/2003 | McPherson et al. | D8/354 |
| 7,726,090 | B2 | 6/2010 | Verelli et al. | |
| 8,327,599 | B2 | 12/2012 | Gavin | |
| 2004/0031228 | A1* | 2/2004 | Hardy et al. | 52/687 |
| 2009/0120030 | A1* | 5/2009 | Garza | 52/686 |

* cited by examiner

*Primary Examiner* — Jessica L Laux
(74) *Attorney, Agent, or Firm* — Greg N. Geiser; Guitwein Law

(57) ABSTRACT

A concrete spacer for use in supporting wire mesh for pouring concrete within a mold. The spacer includes a base portion and an arm portion to offer stability. The base portion is trapezoid shaped and includes a clip for attachment to the wire mesh. The arm portion offers stability and extends opposite the base portion for attachment to the wire mesh.

5 Claims, 3 Drawing Sheets

CONCRETE SPACER WITH SUPPORTING ELEMENT

CROSS REFERENCE TO RELATED APPLICATIONS

This application claims priority to U.S. Provisional Patent Application No. 61/929,820 filed 21 Jan. 2014 to the above named inventors, and is herein incorporated by reference in its entirety.

FEDERALLY SPONSORED RESEARCH

Not Applicable

SEQUENCE LISTING OR PROGRAM

Not Applicable

FIELD OF THE INVENTION

The present invention relates to a concrete spacer and support for use in supporting wire mesh within a mold for pouring concrete.

BACKGROUND OF THE INVENTION

Spacers for positioning and supporting wire mesh and rebar for use in a mold for pouring concrete structures are well known within the art. One type of spacer is known as a wheel style spacer as is shown in U.S. Pat. No. 7,726,090 and U.S. Pat. No. 8,327,599. Each of the spacers, as taught, provides for attachment to a wire mesh frame within its center and provides a resting surface for the wire mesh with spokes radiating from a central hub. The spacer wheel portion has a plurality of protrusions extending outward and contacting a surface for placement and support of the wire mesh. In preparation for the pouring of concrete, the spacer wheel is placed on the wire mesh to support the mesh as it is awaiting placement into a form or mold. Ideally, the wheel spacer can be applied early in the process and support the weight of the wire mesh as it awaits placement into the form or mold.

These known devices are designed to support wire mesh horizontally within a mold and do not have a structure to support the weight of wire mesh when it is used vertically within a mold. Due to the lack of adequate support and structure, when these devices are used to support wire mesh in a vertical orientation they crush over time. This crushing causes production to slow, as additional measures are needed to ensure adequate placement of the mesh within the form. Further, the known devices, due to their shape, have a tendency to rotate out of position and alignment and need to be further secured to the mesh using additional wire ties. Therefore, there is a need for a spacer that can support the weight of the constructed wire mesh in a vertical orientation and provide a firm and secure placement for the pouring of the concrete structure.

SUMMARY OF THE INVENTION

The present invention provides an improved spacer for placement onto a wire mesh or rebar for the pouring of concrete structures. This spacer is comprised of a base portion connected to an arm portion. The base portion has a trapezoidal shape formed from the communication of a pair of opposed sides acting as gussets and supporting a first end and second end opposite the first end. The first end is designed for placement on a bottom of the mold and may include a plurality of fins. The second end includes a base clip for attachment to the mesh structure.

The arm portion extends outward from the second end opposite the first end and has an angular shape culminating in a free end opposite and distal an attached end. The arm portion includes a plurality of clips for attachment to the wire mesh. The plurality of clips attach to the wire mesh on a side opposite the attachment of the base clip, wherein the attachment provides a grasping force to the wire mesh securing the spacer in place.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
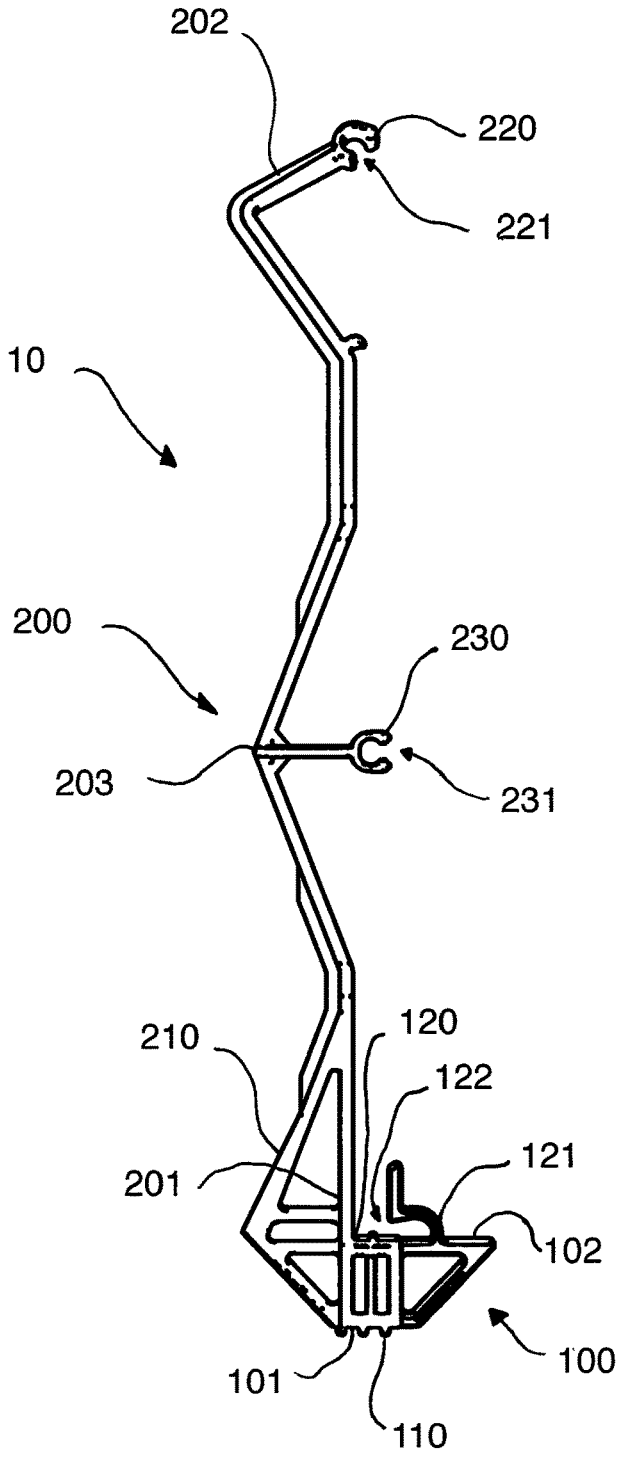
FIG. 1 is a side view of the concrete spacer with supporting element, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
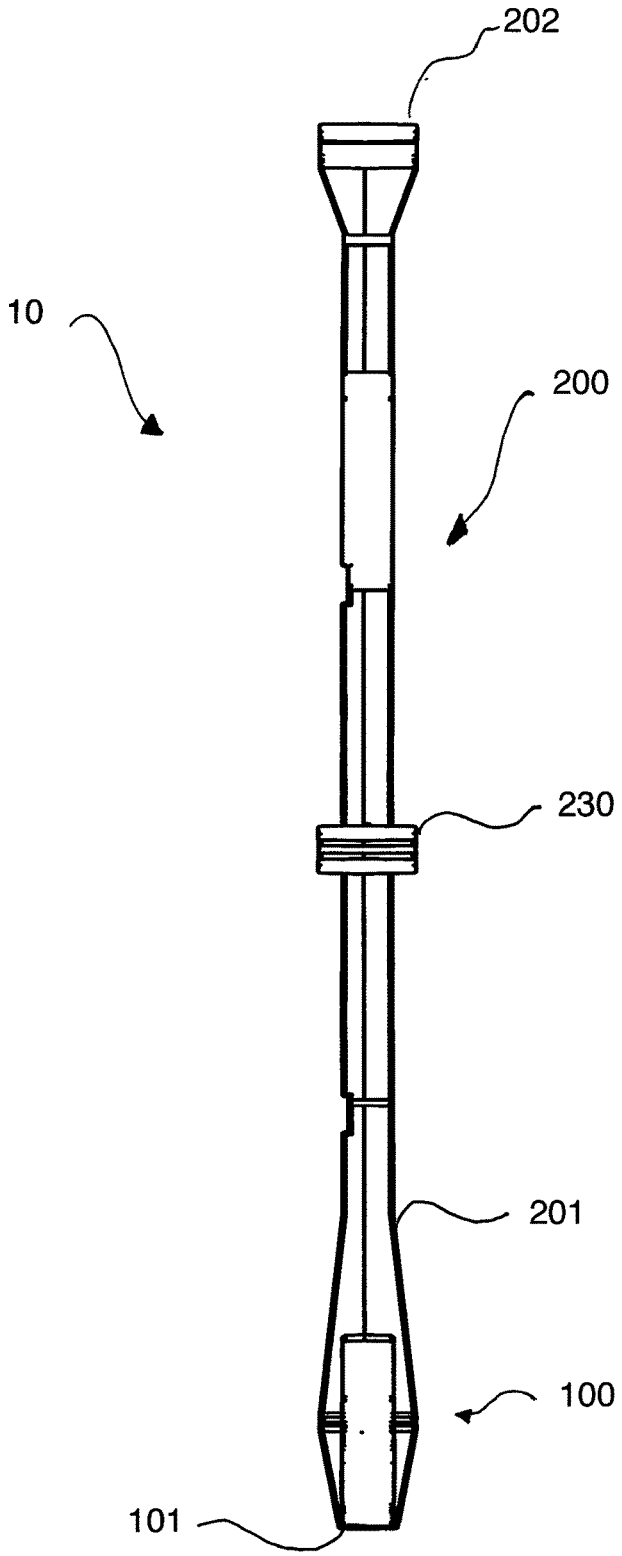
FIG. 2 is a front side view of the spacer, according to the present invention.
Figure 3:
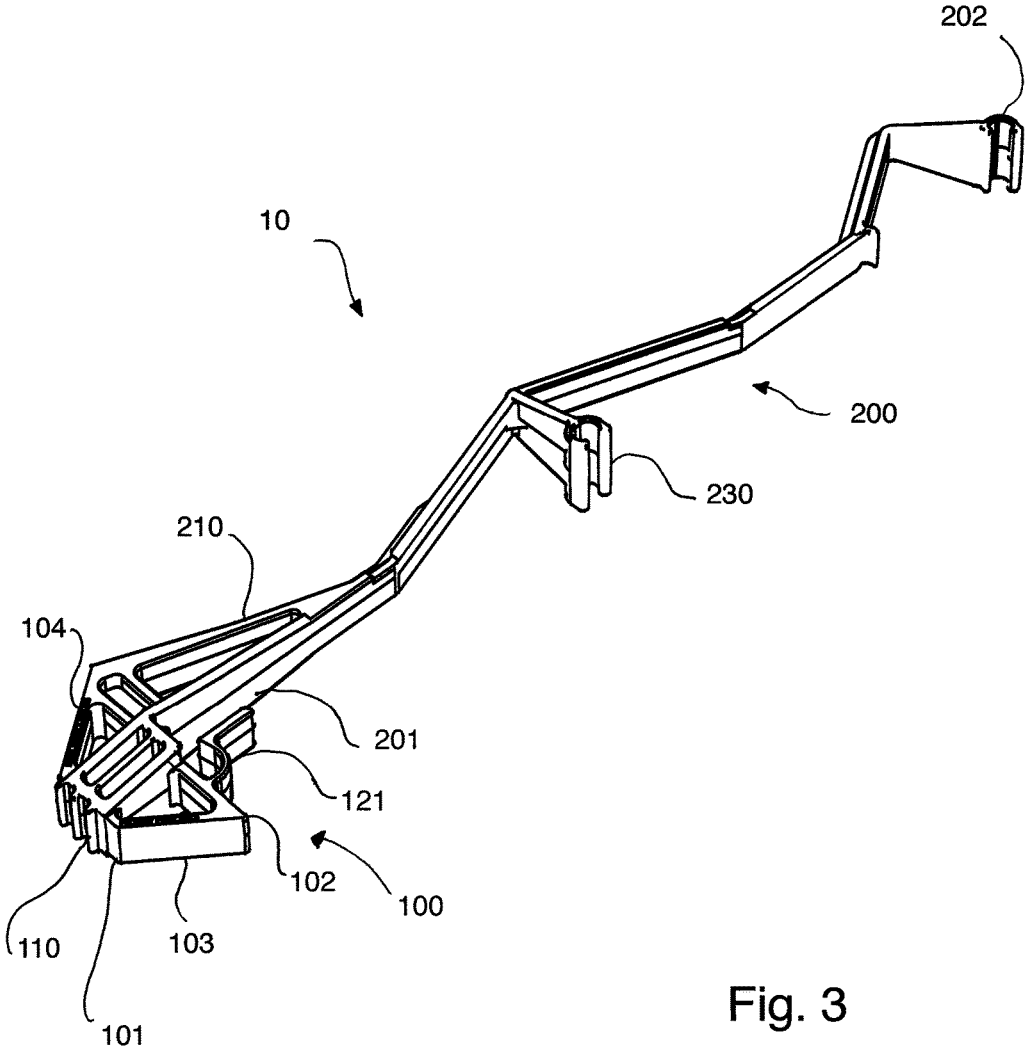
FIG. 3 is an isometric view of the spacer, according to the present invention.

Referring now to FIGS. 1-3 of the concrete spacer with supporting element according to the present invention and generally referred to as 10. The spacer 10 is designed for use in a concrete mold to support a wire mesh, wire, or rebar to provide integrity and strength to poured concrete. The spacer 10 is configured to attach to the wire mesh for vertical positioning and to provide resting support for wire mesh frames waiting for placement within the mold and subsequent concrete pouring.

The spacer 10 is comprised of two main portions: a base portion 100 and an arm portion 200, the arm portion 200 acting as a stabilizing element and connected to the base portion 100. The base portion 100 is configured to provide resting support for the attached wire mesh and is comprised of a first end 101, a second end 102, and a pair of opposed sides 103, 104 providing structural support and acting as gussets to support the base portion 100. In this preferred configuration, the base portion 100 has a substantially trapezoidal shape with the first end 101 having a length less than a length of the second end 102 and the first end 101 and second end 102 being connected by the opposed sides 103, 104.

In this preferred embodiment of the present invention, the first end 101 includes a plurality of fins 110, the fins 110 extending opposite the second end 102 and equally spaced to provide contact with a substrate the base portion 100 is resting on during use. The fins 110 are designed to reduce the contact surface area of the base portion 100 while maintaining a solid foundation for support of the attached wire mesh. The second end 102 includes the attachment point 120 for the arm 200 and a base clip 121. The base clip 121 being crescent shaped and having an opening 122 for receipt of the wire mesh and having a radius corresponding to the size of the wire mesh used, wherein the base clip 121 provides a grasping force and attaches to the wire mesh. The base clip opening 122 is aligned to face the attachment point 120 of the arm portion 200.

The arm portion 200 is connected to a side of the second end 102 at an attached end 201 and extends outward and perpendicular to the second end 102 culminating in a free end 202. The arm portion 200 having an angular shape with a series of V-shaped jogs 203 towards the engaged wire mesh and away from the wire mesh. The arm portion 200 free end 202 culminates in a first clip 220 distal the attached end 201. The first clip 220 is crescent shaped with an opening 221 and having a radius corresponding to the radius of the wire mesh for grasping attachment to the wire mesh. The first clip 220 opening 221 is aligned opposite the opening 122 of the base clip 121, wherein the first clip 220 and the base clip 121 provide opposed grasping forces to secure the spacer 10 to the wire mesh 20.

A second clip 230 is positioned on the arm portion 200 between the first clip 220 and the base clip 121 to provide an additional attachment point for the spacer 10. The second clip 230 is crescent shaped with an opening 231 and having a radius corresponding to the radius of the wire mesh. The opening 231 of the second clip 230 is aligned with the opening 221 of the first clip 220, wherein the opening 231 of the second clip 230 and the base clip 121 provide opposed grasping forces.

The angular shape of the arm portion 200 provides strength to its structure and creates voids between its placement and the wire mesh allowing for the flow of concrete within the mold. The attached end 201 of the arm portion 200 includes a gusset 210 to aid in the strength of the attached end 201 and provide further stability to the spacer 10.

In the preferred embodiment of the present invention, the spacer 10 will be one-piece and formed from a mold. Preferably, the spacer 10 will be comprised of a high density polypropylene (HDPE) plastic for durability, flexion, and cost. Although polypropylene is the preferred type of plastic used other similar materials that offer similar properties may be used. It is desired that any material used have resiliency and an ability to flex allow for minor variations in the wire mesh sizes, configuration, and diameter. In its preferred dimensions, the spacer has a width of at least ½ an inch and length that includes both the arm portion 200 and base portion 100 of at least 12 inches, with a preferred length between 19 inches and 20 inches.

In use, a user will place the spacer 10 unto the wire mesh to be supported within the frame. To do this, a user will first place the base clip 121 onto the bottom side of the wire mesh. After attachment of the base clip 121, the user will rotate the spacer 10 around the bottom of the wire mesh along an axis created by the attachment of the base clip 121. The user will then attach the arm portion 200 to the wire mesh using the first clip 220 and the second clip 230. Accordingly, the base clip 121 will be attached on a side opposite the first clip 220 and second clip 230. The wire mesh will now be adequately supported for the pouring of concrete within the mold.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the specification.

What is claimed is:

1. A concrete spacer for attachment to a wire mesh to support the wire mesh within a mold during concrete pouring, the spacer comprising:

a base portion, the base portion having a first end, the first end having a first length, a second end opposite and parallel to the first end, the second end having a second length, wherein the first length of the first end is less than the second length of the second end, and a pair of opposed sides, the opposed sides positioned between the first end and the second end, the first end, the second end, and the opposed sides forming a trapezoidal shape;

an arm portion, the arm portion affixed to the base portion second end at an attachment point, the arm portion extending outward and perpendicular to the second end from an attached end at the attachment point to a free end, the free end opposite the attached end, the arm portion having an angular shape, the arm portion free end culminates in a first clip, the first clip is crescent shaped with an opening, the opening opposite an opening of a base clip and having a radius corresponding to the diameter of the wire mesh; and the base clip, the base clip positioned on the second end of the base portion, the base clip having the opening, the opening aligned to face the attachment point of the arm portion, the opening having a radius corresponding to the diameter of the wire mesh, wherein the opening of the first clip and the opening of the base clip provide an opposed grasping force to the attached wire mesh.

2. A spacer as in claim 1, wherein a second clip is positioned on the arm portion, the second clip located between the first clip and the base clip, the second clip being crescent shaped with an opening having a radius corresponding to the diameter of the wire mesh, wherein the second clip provides a grasping force to the attached wire mesh.

3. A spacer as in claim 1, wherein the first end of the base portion includes a plurality of fins, the fins extending perpendicular to the first end opposite the second end and equally spaced to provide contact with a substrate the base portion is resting on during use.

4. A concrete spacer for attachment to a wire mesh to support the wire mesh within a mold during concrete pouring, the spacer comprising:

a base portion, the base portion having a first end having a length, a second end having a length greater than the length of the first end and opposite and parallel to the first end, and a pair of opposed sides connected between the first end and the second end, the first end, the second end, and the opposed sides forming a trapezoidal shape, the base portion second end providing a resting surface for supporting the wire mesh and including a base clip, the base clip being crescent shaped and having an opening aligned to face an attachment point of an arm portion, the opening having a radius corresponding to the size of the wire mesh, wherein the base clip provides a grasping force to the wire mesh; and the arm portion, the arm portion affixed to the base portion second end at the attachment point, the arm portion extending outward and perpendicular to the second end opposite the first end from an attached end to a free end, the free end opposite the attached end, the arm portion having an angular shape, the arm portion free end culminates in a first clip, the first clip is crescent shaped with an opening, the opening opposite the opening of the base clip and having a radius corresponding to the diameter of the wire mesh, a second clip, the second clip positioned on the arm portion between the first clip and the base clip, the second clip being crescent shaped with an opening, the opening opposite the opening of the base clip and having a radius corresponding to the diameter of the wire mesh, wherein the first clip and the second clip provide an opposed grasping force to attached wire mesh.

5. A spacer as in claim 4, wherein the first end of the base portion includes a plurality of fins, the fins extending perpendicular to the first end opposite the second end and equally spaced to provide contact with a substrate the base portion is resting on during use.

* * * * *